United States Patent [19]

Davis

[11] 4,309,884

[45] Jan. 12, 1982

[54] PADDLE LOCK WITH GUARD-PROTECTED HANDLE DISCONNECT MEMBER

[75] Inventor: Edwin W. Davis, Medina, Ohio.

[73] Assignee: The Eastern Company, Cleveland, Ohio

[21] Appl. No.: 107,858

[22] Filed: Dec. 28, 1979

[51] Int. Cl.[3] ..... E05B 55/04

[52] U.S. Cl. ..... 70/472; 70/149; 70/221; 70/416; 70/489; 292/173; 292/DIG. 27; 292/DIG. 31

[58] Field of Search ..... 70/472, 488, 489, 149, 70/204, 218, 221–224, 416; 292/167, 223, 226, DIG. 27, DIG. 31, DIG. 37, 173

[56] References Cited

U.S. PATENT DOCUMENTS

| | | |
|---|---|---|
| 269,953 | 1/1883 | Moritz . |
| 528,450 | 10/1894 | Swanberg . |
| 1,751,184 | 3/1930 | Wodarra . |
| 1,785,381 | 12/1930 | Holtzman . |
| 1,840,062 | 1/1932 | Taylor . |
| 1,909,210 | 5/1933 | Miller . |
| 1,911,564 | 5/1933 | Gahagan . |
| 1,960,410 | 5/1933 | Christensen . |
| 1,964,066 | 6/1934 | Kuszmaul . |
| 2,053,805 | 9/1936 | Van Note . |
| 2,075,948 | 4/1937 | Kuszmaul . |
| 2,117,715 | 5/1938 | Godfried . |
| 2,274,455 | 2/1942 | Murphy . |
| 2,322,892 | 6/1943 | Springer . |
| 2,453,505 | 11/1948 | Fornwald . |
| 2,459,029 | 1/1949 | Ingres et al. . |
| 2,468,644 | 4/1949 | Springer . |
| 2,582,928 | 1/1952 | Dall . |
| 2,603,963 | 7/1952 | Allen . |
| 2,629,618 | 2/1953 | Roethel . |
| 2,649,321 | 8/1953 | Smith . |
| 2,658,781 | 11/1953 | Allen . |
| 2,700,290 | 1/1955 | Dall . |
| 2,705,882 | 4/1955 | Craig . |
| 2,705,884 | 4/1955 | Craig . |
| 2,723,145 | 11/1955 | Smith . |
| 2,728,214 | 12/1955 | Craig . |
| 2,772,908 | 12/1956 | Craig . |
| 2,773,716 | 12/1956 | Craig . |
| 2,782,062 | 2/1957 | Smith . |
| 2,877,043 | 3/1959 | Leslie . |
| 2,955,864 | 10/1960 | Van Voorhees . |
| 2,978,895 | 4/1961 | Heisler . |
| 2,987,907 | 6/1961 | Cockburn et al. . |
| 3,007,731 | 11/1961 | Roethel . |
| 3,044,814 | 7/1962 | Pelcin ..... 70/489 X |
| 3,069,889 | 12/1962 | Johnstone et al. . |
| 3,104,124 | 9/1963 | Beck . |
| 3,121,580 | 2/1964 | Di Salvo et al. . |
| 3,129,026 | 4/1964 | Gergoe et al. . |
| 3,153,551 | 10/1964 | Sandor et al. . |
| 3,171,677 | 3/1965 | Klove, Jr. et al. . |
| 3,309,127 | 3/1967 | Pickles . |
| 3,314,708 | 4/1967 | Welch . |
| 3,386,760 | 6/1968 | Bessette . |
| 3,394,957 | 7/1968 | Foley . |
| 3,423,117 | 1/1969 | Klove, Jr. et al. . |
| 3,587,259 | 6/1971 | Sandor . |
| 3,649,061 | 3/1972 | Meyer . |
| 3,672,713 | 6/1972 | Pickles . |
| 3,679,251 | 7/1972 | Brockman et al. . |
| 3,695,660 | 10/1972 | Fetters . |
| 3,695,663 | 10/1972 | Cockburn . |
| 3,697,105 | 10/1972 | Marx . |
| 4,116,027 | 9/1978 | Tannery . |
| 4,170,119 | 10/1979 | Kalis, Jr. ..... 70/149 X |

FOREIGN PATENT DOCUMENTS

| | | |
|---|---|---|
| 135399 | 9/1947 | Australia . |
| 717308 | 2/1942 | Fed. Rep. of Germany . |

OTHER PUBLICATIONS

Brochure describing a complex Atwood Lock.

*Primary Examiner*—William E. Lyddane
*Attorney, Agent, or Firm*—Burge & Porter Co.

[57] ABSTRACT

A door lock has a flush-mountable body. A forwardly facing recess is defined by the body. A paddle-type handle is pivotally carried by the body and is movable between a nested position within the body recess and an operating position. A spring-projected slide bolt is carried on the back of the body and is movable between projected and retracted positions. A key-controlled disconnect linkage is provided for selectively connecting and disconnecting the handle and the bolt. The disconnect linkage includes an operating member which is pivotally mounted on the body at a location behind the handle, a key-control which is carried on the handle, and a disconnect member which is carried by the key control for movement into and out of driving engagement with the operating member. The operating member has an arm which extends through an opening formed in the back of the body and into driving engagement with the bolt. A two-piece guard shields the members of the disconnect linkage from access by would-be intruders. When the disconnect linkage drivingly connects the handle and the bolt, movement of the handle from its nested position to an operating position will cause corresponding retracting movement of the bolt. When the disconnect linkage disconnects the handle from the bolt, movement of the handle is inoperative to cause retracting movement of the bolt. A feature of the disconnect linkage is that it provides the lock with a "slam" capability, meaning that when the bolt is projected, it can be slammed into latching engagement with a suitably configured strike regardless of whether the disconnect linkage is drivingly connecting or disconnecting the handle and the bolt.

30 Claims, 6 Drawing Figures

PADDLE LOCK WITH GUARD-PROTECTED HANDLE DISCONNECT MEMBER

CROSS-REFERENCE TO RELATED APPLICATIONS

PADDLE LOCKS WITH HANDLE DISCONNECT FEATURES, Ser. No. 108,007 filed concurrently herewith on Dec. 28, 1979 by John V. Pastva, Jr., hereinafter "Disconnect Case I."

PADDLE LOCK WITH PIVOTALLY MOUNTED HANDLE DISCONNECT MEMBER, Ser. No. 108,010 filed concurrently herewith on Dec. 28, 1979 by Albert L. Pelcin, hereinafter "Disconnect Case II."

PADDLE LOCK WITH BOLT-CARRIED HANDLE DISCONNECT MEMBER, Ser. No. 107,859 filed concurrently herewith on Dec. 28, 1979 by John V. Pastva, Jr. and Albert L. Pelcin, hereinafter "Disconnect Case III."

PADDLE LOCK WITH ROTATABLY-MOUNTED HANDLE DISCONNECT MEMBER, Ser. No. 108,017 filed concurrently herewith on Dec. 28, 1979 by James A. Reed and Edwin W. Davis, hereinafter "Disconnect Case IV."

PADDLE LOCK WITH TRANSLATABLY-MOUNTED HANDLE DISCONNECT MEMBER, Ser. No. 108,015 filed concurrently herewith on Dec. 28, 1979 by Edwin W. Davis, hereinafter "Disconnect Case V."

PADDLE LOCK WITH HANDLE DISCONNECT, Ser. No. 108,016 filed concurrently on Dec. 28, 1979 by Jye P. Swan, John V. Pastva, Jr. and Donald J. Dignan, hereinafter "Disconnect Case VI."

FLUSH-MOUNTABLE LOCK WITH ACTUATOR DISCONNECT FEATURE, Ser. No. 108,011 filed concurrently herewith on Dec. 28, 1979 by Edwin W. Davis, hereinafter "Disconnect Case VIII."

The present application and the applications cross-referenced above have been assigned to a common entity, The Eastern Company, a corporation of Connecticut.

BACKGROUND OF THE INVENTION

1. Field of the Invention

The present invention relates generally to a door lock having a spring-projected slide bolt, a handle for retracting the bolt, and a key control for selectively permitting and preventing the handle from retracting the bolt. More particularly, the invention relates to a lock of this type including a key-controlled disconnect linkage for selectively drivingly connecting and disconnecting the handle and the bolt, whereby the handle is, at all times, freely movable between normal and operating positions, but is functional only when the key control is "unlocked" to enable the handle to retract the bolt.

While the present invention has particularly advantageous use in conjunction with flush-type door locks used on swinging doors of vehicles, industrial cabinets, electrical equipment enclosures and the like, principles of the invention are not limited in application to such uses.

2. Prior Art

Flush-type door locks including a body, a lock bolt slidably carried on the body, and an operating handle for moving the bolt relative to the body are well known. Normally the handle is in a flush or nested position when the bolt is projected. Bolt retraction is effected by pivoting the handle to an operating position. Locks of this type are well suited for use on swinging doors of vehicles such as trucks, on merchandise, tool and equipment cabinets, electrical equipment enclosures and the like.

Flush-type, paddle-handle door locks employing key-operated rotatable cams for selectively permitting and preventing unlocking movements of operating handles, and having spring-projected slide bolts, are described in U.S. Pat. Nos. 3,707,862, and 3,668,907 granted Jan. 2, 1973 and June 13, 1972, respectively, to John V. Pastva, Jr. An ornamental appearance employed in locks of this general type is illustrated in U.S. Pat. No. De. 230,132 issued Jan. 29, 1974 to John V. Pastva, Jr.

The provision of a handle disconnect feature in a door lock is desirable in that the presence of such a feature will lessen, if not totally eliminate, incidents of these locks being damaged by would-be intruders. Since the handles of most previously proposed door locks are restrained from moving when the locks are locked, it is common for would-be intruders to attempt to gain entry by applying excessive leverage force to the lock handles. Where handle disconnect features are provided, the lock handles may always be moved freely, but are functional to retract the bolt only when the locks are "unlocked." Locks having handle disconnect features can be made practically entry-proof short of the application of such forces as will totally destroy the locks.

Door locks employing various types of handle disconnect systems have been proposed. Prior proposals have, however, suffered from a variety of drawbacks including complexities of construction; failures to mount all of the operating parts of a lock on a single body member so that the resulting locks form compact, easy to install units; and inappropriately configured parts of sizes and shapes that prohibit installation of locks embodying such proposals in conventionally configured door lock mounting openings.

One prior proposal for a flush-type, paddle-handle door lock incorporating a handle disconnect feature has utilized a disconnect system having releasably engageable components located immediately behind the handle of the lock, at a location on the front side of the lock body. A problem with the "front-mounted" disconnect system utilized in this prior proposal is that access may be had to the disconnect member by a would-be intruder using an elongate tool such as a screwdriver, whereby the locking operation of the key control can be overcome. An advantage of front-mounted disconnect systems is that substantially conventionally-configured lock components may be utilized at locations behind the lock body, thereby minimizing the costs involved in adding a disconnect system to a conventional flush-mountable paddle-handle locks.

3. The Cross-Referenced Disconnect Patents

The present invention and the inventions described in the several referenced Disconnect Case represent the work products of a continuous and continuing development program which began nearly a decade ago.

The several handle disconnect systems described in the referenced Disconnect Case were developed by coworkers operating, in some instances independently, and in other instances jointly, as is reflected in the naming of sole and joint inventors. Many of the disconnect system features claimed in separate ones of the referenced Disconnect Patents were developed substantially concurrently.

Where a claim in one of the referenced Disconnect Patents is found to be generic to a development concept utilized in another of these patents, it should be understood that care has been taken to present the generic claim in the patent which describes the earliest development of a species that will support the generic claim. In this manner, a careful effort has been made to establish clear lines of demarcation among the claimed subjects matter of this and the several referenced Disconnect Patents. No two of these patents include claims of identical scope.

SUMMARY OF THE INVENTION

The present invention overcomes the foregoing and other drawbacks of the prior proposals by providing a novel and improved, reliable and durable, handle-operated door lock which includes a simple but effective, key-controlled, disconnect linkage for selectively drivingly connecting and disconnecting an operating handle and a spring-projected slide bolt.

A door lock embodying principles of the present invention preferably includes a support structure or body having side and back walls which cooperate to define a forwardly-facing recess. A bolt is slidably supported on the body at a location behind the back wall. The bolt is movable between projected and retracted positions with respect to the body, and a compression coil spring biases the bolt toward its projected position. A handle is supported on the body for swinging movement between a nested position and an operating position. Handle return springs bias the handle toward its nested position.

A key-controlled disconnect linkage includes a key-control mounted on the handle and having a locking member which is movable between locked and unlocked positions. A disconnect member is carried by the locking member at a location behind the handle and forwardly of the lock body. An operating member is pivotally mounted on the lock body and has an arm which extends through an opening formed in the back wall of the body to a position where it drivingly engages the bolt. The disconnect and operating members have interengageable formations which may be brought into and out of driving engagement to selectively connect and disconnect the handle and the bolt. When the locking member is in its locked position, it positions the disconnect member to disengage the operating member, and thereby disconnects the handle and the bolt such that movement of the handle will cause no corresponding movement of the bolt. When the locking member is in its unlocked position, it positions the disconnect member to drivingly engage the operating member, thereby drivingly connecting the handle and the bolt such that, when the handle is moved out of its nested position to an operating position, the bolt is caused to retract.

The disconnect linkage includes several improvements over previously proposed handle disconnect systems. It is formed from relatively simple and inexpensive elements which occupy very little space and which provide a disconnect function at a suitably guarded location behind the handle. Two sets of interengageable formations are provided on the disconnect and operating members so that a strong, positive driving connection is provided between these members when the interengageable formations are engaged.

A pair of guard members cooperate in a particularly effective manner to prevent unauthorized access to the vicinity of the members of the disconnect linkage, thereby providing improved reliability and security.

As will be apparent from the foregoing summary, a feature of the present invention lies in the provision of a novel and improved door lock with a key-controlled disconnect system for selectively drivingly connecting and disconnecting the handle and the bolt.

These and other features and a fuller understanding of the present invention may be had by referring to the following detailed description and claims taken in conjunction with the accompanying drawings.

DESCRIPTION OF THE PREFERRED EMBODIMENT

Figure 1:
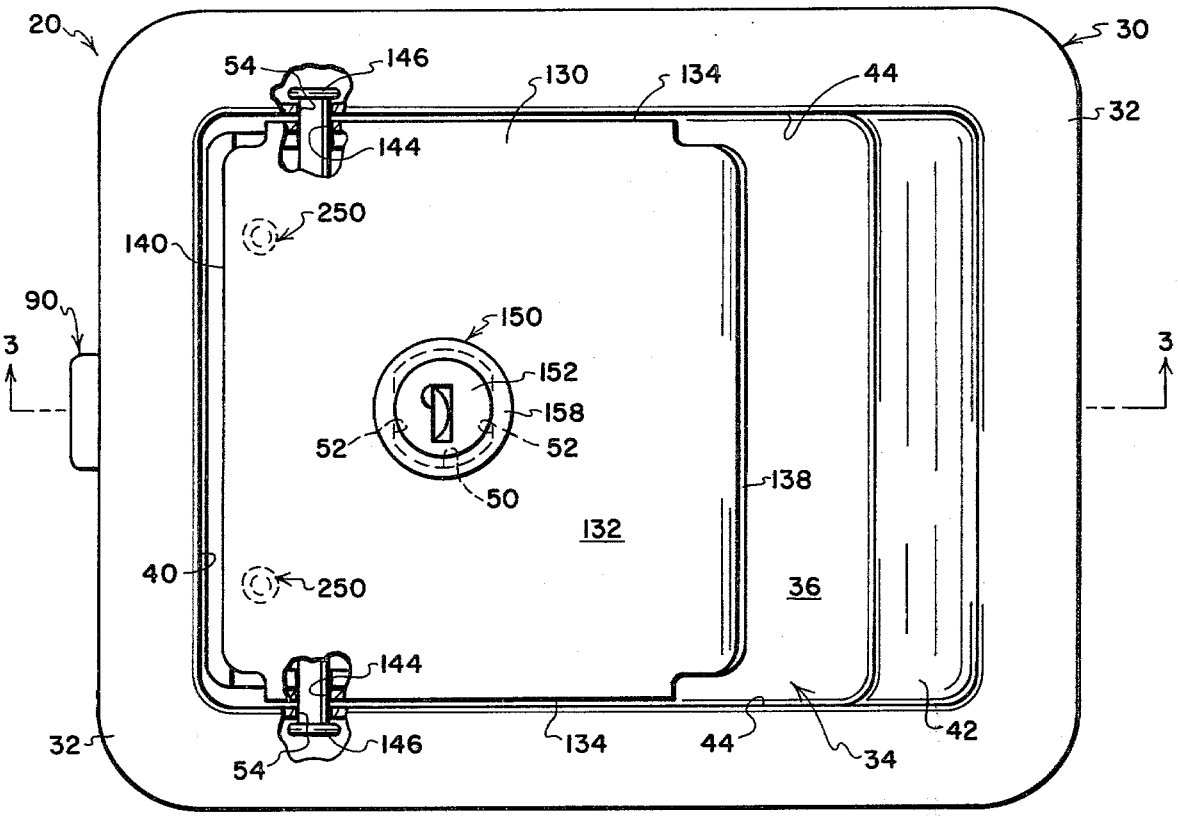
FIG. 1 is a front side elevational view of a lock embodying the preferred practice of the present invention, with portions broken away to permit underlying components to be viewed, the components of the lock being positioned in an unlocked attitude, with the handle nested and the bolt projected.
Figure 2:
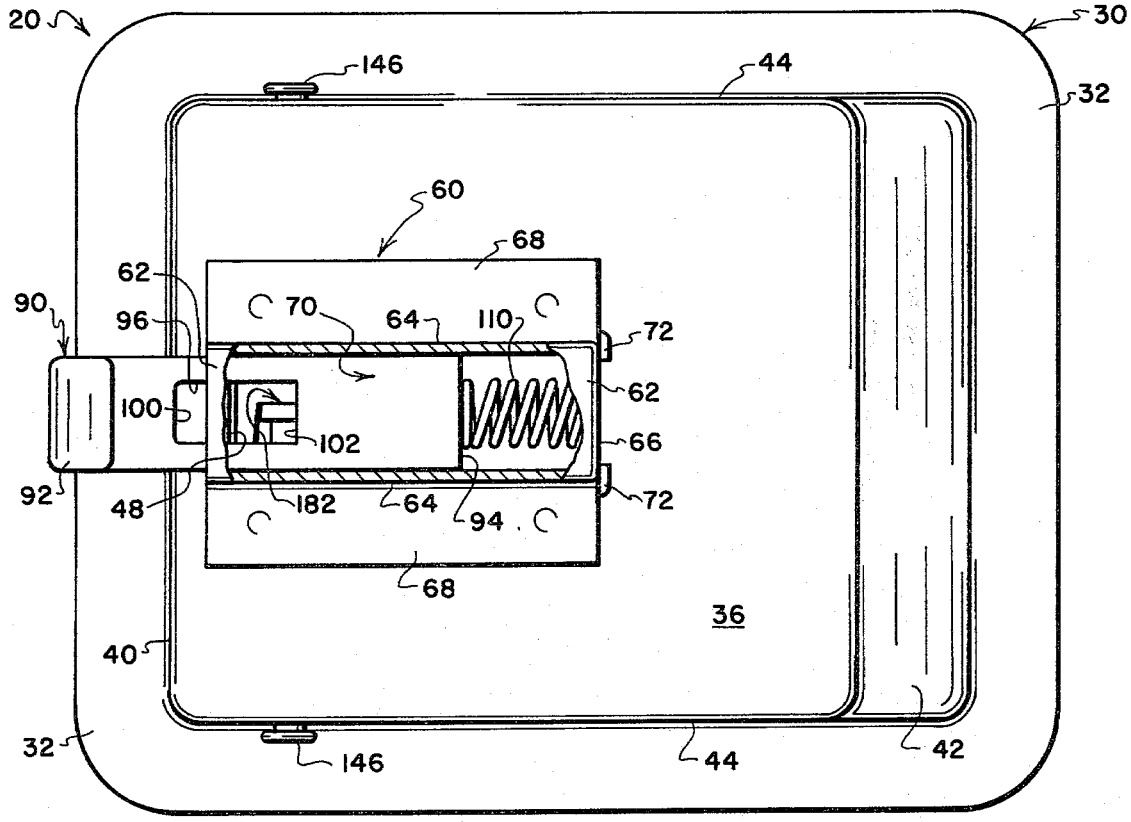
FIG. 2 is a rear side elevational view of the lock of FIG. 1 with portions broken away to permit underlying components to be viewed, with the components of the lock positioned as shown in FIG. 1.

Referring to FIGS. 1–6, a key-controlled, paddle-handle, flush-mountable lock incorporating the preferred practice of the present invention is indicated generally by the numeral 20. The lock 20 is adapted to be supported on such structures as a swinging door (not shown) for relative movement therewith to bring the lock 20 into and out of juxtaposition with a suitably configurated strike (not shown) supported on a door frame or other structure (not shown). The manner in which locks of this general type are mounted on doors is well known to those skilled in the art. The mounting of such locks is described and illustrated in such patents as Pastva, Jr., U.S. Pat. No. 3,668,907.

In general, the lock 20 includes a recessed body 30 having a bolt housing 60 welded to the rear side of the body 30. The bolt housing 60 and the back wall of the body 30 cooperate to define elongate passage 70. A bolt 90 is slidably carried in the passage 70 for movement between retracted and projected positions. A compression coil spring 110 biases the bolt 90 toward its projected position. A paddle handle 130 is pivotally carried on the body 30 for movement between nested and operating positions. A key control 150 and a disconnect linkage 180 are provided for selectively drivingly interconnecting and disconnecting the handle 130 and the bolt 90. The disconnect linkage 180 includes an operating member 182 and a disconnect member 184 which have drivingly interengageable formations located behind the handle 130 and forwardly of the body 130. A pair of guard members 230,240 underlie the handle 130 and cooperate to shield the disconnect linkage 180 from intruder access. A pair of handle return springs 250 are interposed between the guard members 230, 240 and operate to bias the handle 130 toward its nested position.

The body 30 is a rectangular, pan-shaped metal stamping having a perimetrically extending flange 32 which surrounds a forwardly facing recess 34. A back wall 36 defines the back of the recess 34. A forwardly extending left end wall 40, an inclined right end wall 42, and side walls 44 connect the back wall 36 with the flange 32. An elongate slot 48 is provided in the back wall 36 at a location overlying the bolt 90. Aligned holes 54 are formed through the side walls 44 near their left ends.

The bolt housing 60 is a channel-shaped sheet metal stamping having a bottom wall 62, a pair of opposed side walls 64, an end wall 66, and a pair of mounting flanges 68. The flanges 68 overlie and are welded to the rear side of the left back wall portion 36.

The bolt housing 60 cooperates with the left back wall portion 36 to define the passage 70 within which the bolt 90 is guided for sliding movement. The end wall 66 is formed as an integral part of the bottom wall 62, and operates to close a majority of the area of the right end of the bolt passage 70. The side walls 64 have a pair of integrally formed locking tabs 72 which are folded to overlie the end wall 66 to reinforce the end wall 66.

The bolt 90 is a solid metal member which can be formed by conventional casting or powder metallurgy techniques. The bolt 90 has a generally rectangular cross section which corresponds to that of the passage 70. The bolt 90 has a tapered left end 92 configured, as is conventional, to permit the bolt 90 to be retracted in response to slamming engagement with a suitably configured strike (not shown). The bolt 90 has a flat right end 94. The bolt 90 has a receiving formation which preferably takes the form of an elongate slot 96 provided in the central part of the bolt 90. The bolt slot 96 has left and right end walls 100, 102 at its opposite ends.

Figure 3:
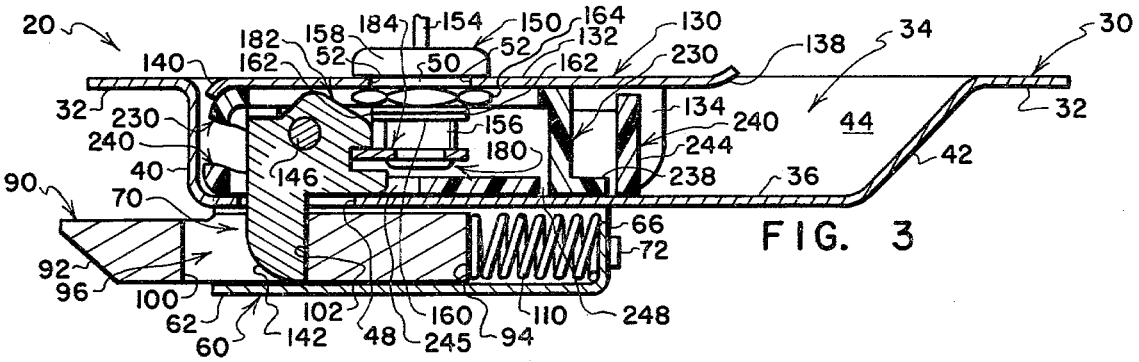
FIG. 3 is a sectional view as seen from a plane indicated by a line 3—3 in FIG. 1, with the components of the lock positioned as shown in FIG. 1.
Figure 4:
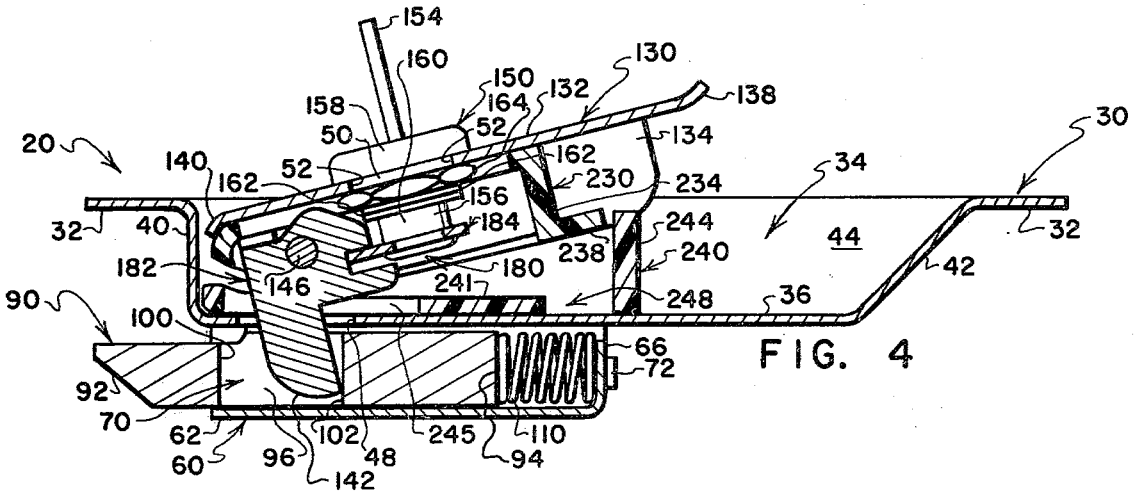
FIG. 4 is a sectional view similar to FIG. 3 with the components of the lock being positioned in an unlocked attitude, with the handle extended to an operating position and with the bolt retracted.

The bolt 90 is movable between a projected or latching position, shown in FIGS. 1–3 and 5, and a retracted or unlatching position shown in FIG. 4. When the bolt 90 is projected, its tapered left end 92 extends beyond the left edge of the body flange 32. When the bolt 90 is retracted, its tapered left end 92 is retracted with respect to the left edge of the body flange 32.

The compression coil spring 110 is positioned in the passage 70. The spring 110 has a left end which engages the bolt end 94, and a right end which engages the bolt housing end wall 66. The spring 110 biases the bolt 90 leftwardly toward its projected position, and is compressed to progressively greater degrees as the bolt 90 is retracted.

The paddle handle 130 is a sheet metal stamping having a generally rectangular, substantially flat plate portion 132 and a pair of opposed, inwardly-turned side flanges 134. An outwardly-turned gripping flange 138 is provided at the right end of the handle 130, and an inwardly-turned flange 140 is provided at the left end.

The handle 130 has aligned mounting holes 144 formed through its side flanges 134. A headed pin 146 extends through the body holes 54 and through the handle mounting holes 144 to pivotally mount the handle 130 on the body 30 at a location between the body side walls 44. A key-control mounting hole 50 is formed through the flat plate portion 132. The hole 50 has a pair of flats 52 formed on its opposite sides.

Figure 5:
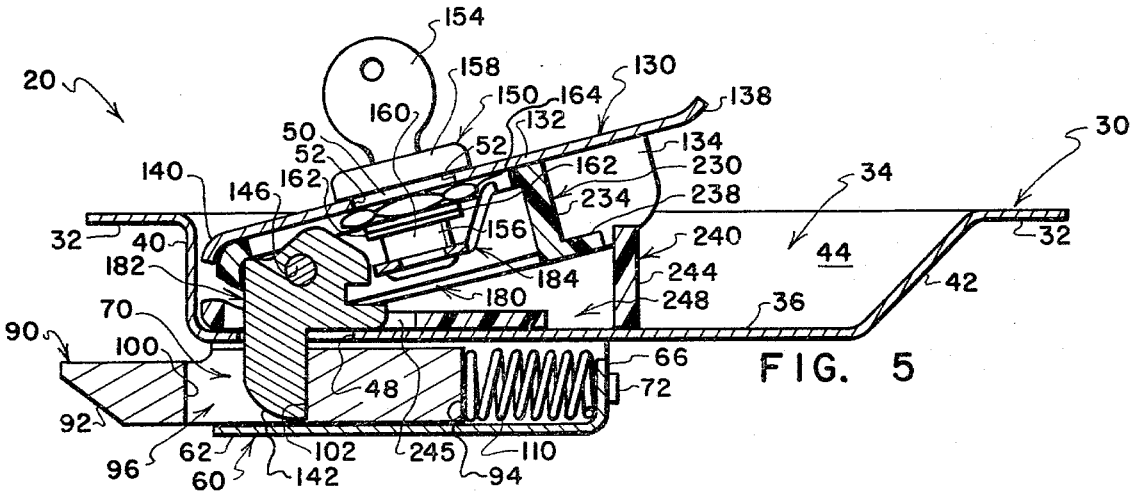
FIG. 5 is a sectional view similar to FIG. 4 with the components of the lock being positioned in a locked attitude, with the handle extended to an operating position, and with the bolt nonetheless still projected; and, FIG. 6 is an exploded perspective view of certain of the components of the lock, with portions broken away to permit otherwise hidden features to be viewed.

When the handle 130 is moved out of its nested position to an operating position by pivoting it counterclockwise about the axis of the pin 146, as shown in FIGS. 4 and 5, the spring 110 may or may not be compressed depending on whether the disconnect member 184 is in what will be termed its "connecting" position or its "disconnecting" position. When the disconnect member 184 is in its connecting position, as shown in FIGS. 1–4, the disconnect member 184 drivingly engages the operating member 182 to provide a driving connection between the handle 130 and the bolt 90. when the disconnect member 184 is in its connecting position, the bolt 90 is caused to retract rightwardly in the passage 70 as the handle 130 pivots out of its nested position. In FIG. 5 the disconnect member 184 is shown in its disconnecting position wherein it disengages the operating member 182 and thereby provides no driving connection between the handle 130 and the bolt 90. When the handle 130 is pivoted about the axis of the pin 146 with the disconnect member 184 in its disconnecting position, no corresponding movement of the bolt 90 takes place.

The key control 150 includes a lock cylinder 152 into which a key 154 may be inserted. The key 154 is configured to cooperate with tumblers housed within the cylinder 152 to permit a generally cylindrical locking member 156 to be rotated between locked and unlocked positions. The disconnect member 184 is rigidly secured to the locking member 156 for rotation with the locking member 156. The unlocked position of the locking member 156 and the connecting position of the disconnect member 184 are shown in FIGS. 1–4. The locked position of the locking member 156 and the disconnecting position of the disconnect member 184 are shown in FIGS. 5–6.

The cylinder 152 is provided with an enlarged head 158 and a threaded body 160. A pair of flats 162 are formed on opposite sides of the threaded body 160. The cylinder 152 is positioned with its head 158 engaging the forward surface of the flat plate portion 132, with its body 160 extending through the hole 50, and with its flats 162 engaging the flat surfaces 52. A locknut 164 is threaded onto the body 160 to hold the cylinder 152 in place on the handle 130.

While the key control 150 is of a conventional, commercially available type, it is selected from among various commercially available key controls which have particular operational characteristics. These operational characteristics should include key removal capability when the locking member 156 is positioned in either of its locked and unlocked positions. A further characteristic of the key control 150 is that, once the locking member 156 has been positioned in either of its locked or unlocked positions and the key 154 has been removed from the cylinder 152, the key control 150 maintains the locking member 156 in such position.

Figure 6:
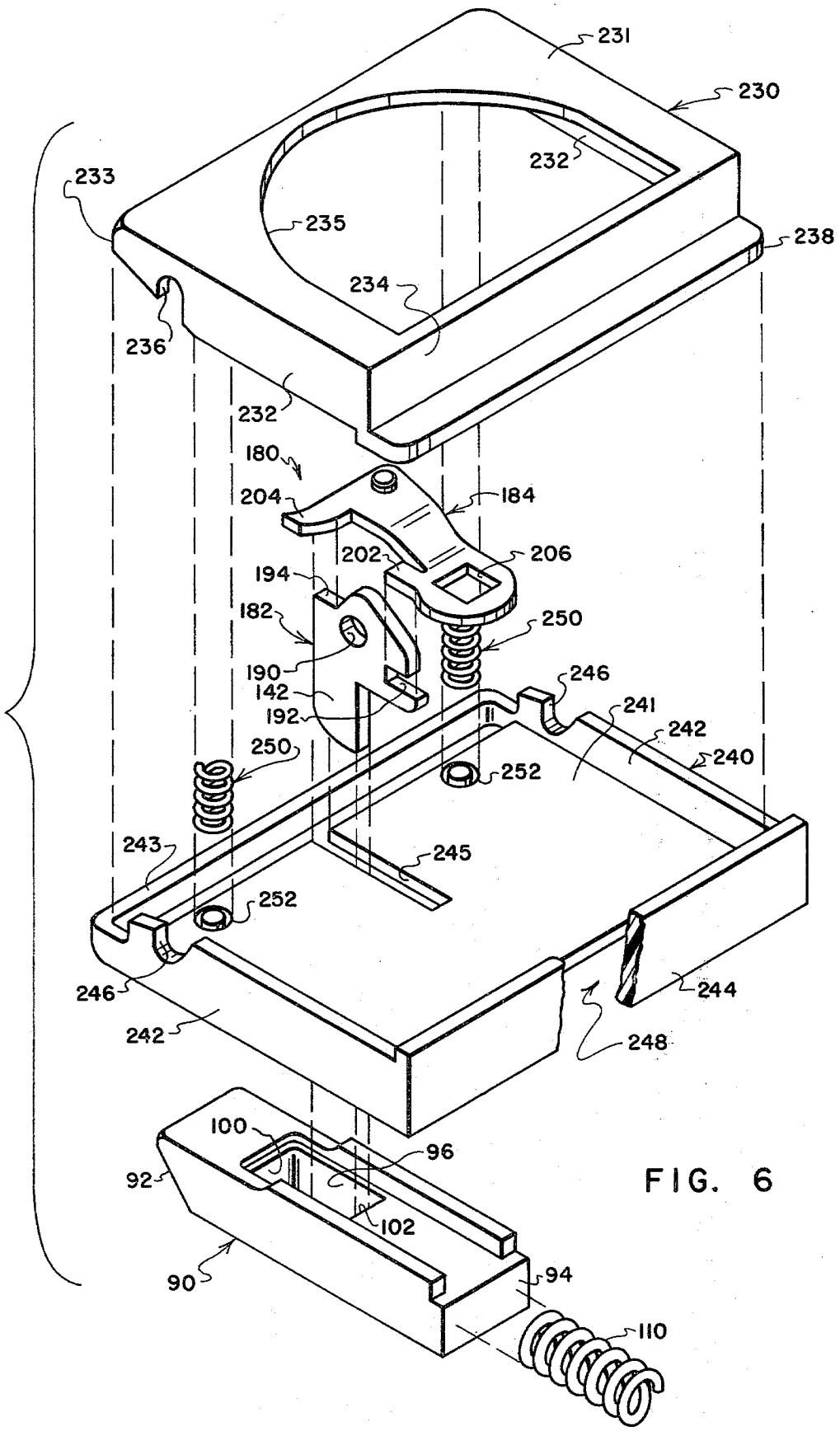

Referring to FIG. 6, the operating member 182 is an L-shaped member having a hole 190 formed centrally therethrough. The pin 146 extends through the hole 190 to pivotally mount the operating member 182 on the body 30. An operating arm portion 142 depends through the back wall opening 48 and into the bolt slot 96. A slot 192 is formed on one side of the axis of the hole 190, and an abutment surface 194 is formed on the other side of the axis of the hole 190.

The disconnect member 184 is of hook-shape, having lower and upper abutment formations 202, 204 which are configured to drivingly engage the slot 192 and the abutment surface 194, respectively, when the disconnect member 184 is in its connecting position. The upper abutment formation is slightly curved to facilitate its positioning the operating member 182 to receive the lower abutment formation 202 in the slot 192. A square hole 206 serves to couple the disconnect member to a corresponding square drive formation (not shown) provided on the locking member 156.

When the locking member 156 is in its locked position and thereby causes the disconnect member 184 to assume its disconnecting position, pivotal movement of the handle 130 from its nested position, shown in FIG. 3, to an operating position, shown in FIG. 5, will cause the locking member 156 and the disconnect member 184 to pivot forwardly with the handle 130, but will cause no corresponding movement of the bolt 90. Stated in another way, when the locking member 156 is in its locked position as shown in FIG. 5, no driving connection is established between the handle 130 and the bolt 90. Under these circumstances, the handle 130 can be moved freely without causing any corresponding movement of the bolt 90, as is illustrated in FIG. 5.

When the locking member 156 is in its unlocked position and thereby causes the disconnect member 184 to drivingly engage the operating member 182 with the abutment formations 202, 204 being received by the slot and the abutment surface 192, 194, respectively, pivotal movement of the handle 130 from its nested position to its operating position will cause the operating member 182 to pivot about the pin 146, and will cause the bolt 90 to retract, as shown in FIG. 4. Stated in another way, when the locking member 156 is in its unlocked position as shown in FIG. 4, a driving connection is established between the handle 130 and the bolt 90. Under these circumstances, movement of the handle 130 to its operating position will cause corresponding retracting movement of the bolt 90, as is illustrated in FIG. 4.

As is seen in FIGS. 3–5, the operating arm 142 is normally spaced from the left end surface 100 of the slot 96. The spacing between the slot end surface 100 and the operating arm 142 provides a lost motion connection which permits the bolt 90 to be retracted, i.e. moved rightwardly in the passage 70, without requiring corresponding pivotal movement of the handle 130. This feature is desirable because it provides the lock 20 with a capability to be "slammed" to bring the bolt 90 into latching engagement with a suitably configured strike (not shown) without causing the handle 130 to pivot out of its nested position.

Referring to FIG. 6 in conjunction with FIGS. 3–5, the guard member 230 has a flat front wall portion 231 which lies alongside the rear surface of the handle portion 132. A pair of depending side walls 232 lie alongside the handle side walls 134. Left and right end walls 233, 234 are provided at opposite ends of the front wall portion 231. A cutout 235 is provided in the front wall portion 231 to receive the locking member 156 and the disconnect member 184. A pair of aligned notches 236 are formed in the side walls 232 to receive the handle mounting pin 146. A rightwardly projecting guard flange 238 is provided at the base of the right end wall 234.

The guard member 240 has a flat back wall portion 241 which lies alongside the body back wall 36. A pair of side walls 242 extend forwardly alongside the side walls 232. Left and right end walls 243, 244 are provided at opposite ends of the side walls 242. An elongate slot 245 is provided in the back wall portion 241 to receive portions of the operating member 182. A pair of notches 246 are formed in the side walls 242 to receive the handle mounting pin 246. A space 248 is provided between the right end of the bottom wall portion 241 and the right end wall 244 to receive the right end wall 234 and the guard flange 238, as is best seen in FIGS. 3–5.

Referring again to FIG. 6, the handle return springs 250 are compression coil springs which are interposed between the guard members 230, 240 at spaced locations to the left of the axis of the handle mounting pin 146. The ends of the springs 250 are received in recessed formations 252 formed in the guard member 240, as shown in FIG. 6, and in similarly configured recessed formations (not shown) formed in the guard member 230. The springs 250 bias the left end regions of the guard members 230, 240 relatively away from each other, and this biasing action is transmitted through the guard member 230 to the handle 130 to bias the handle 130 toward its nested position with respect to the body 30.

The forward guard member 230 is held in firm engagement with the handle 130 by the engagement of the inner ends of its notches 236 with the handle mounting pin 146. The rearward guard member 240 is held in firm engagement with the body 30 by the engagement of the inner ends of its notches 246 with the handle mounting pin 146.

When the handle 130 is in its normal or nested position, as shown in FIG. 3, the guard end walls 234, 244 overlie each other to shield the location of the disconnect linkage 180 from intruder access. When the handle 130 is moved to its operating position, as shown in FIGS. 4 and 5, the right end walls 234, 244 and the guard flange 238 cooperate to shield the disconnect linkage 180 from intruder access.

While the guard members 230, 240 are preferably formed from rigid plastics materials, they may also be formed from metal.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A door lock, comprising:

(a) a body structure;

(b) a bolt structure connected to the body structure for movement between latching and unlatching positions, the bolt structure having a connecting formation connected thereto for movement along a first path of travel relative to the body structure in response to movement of the bolt structure between its latching and unlatching positions;

(c) a handle structure connected to the body structure for movement between normal and operating positions;

(d) key control means connected to the handle structure and having a locking member which is movable relative to the handle structure between locked and unlocked positions, the key control means being operable to selectively retain the locking member in its locked and unlocked positions;

(e) operating means having an operating formation connected thereto for movement between first and second positions along a second path of travel relative to the body structure, and being operable to drivingly engage the connecting formation to effect movement of the bolt structure from its latching position to its unlatching position in response to movement of the operating formation from its first position to its second position;

(f) disconnect means interposed between the operating means and the locking member for selectively drivingly connecting and disconnecting the operating means and the locking member to thereby selectively drivingly connect and disconnect the handle and bolt structures, the disconnect means including a disconnect member which is movable along a third path of travel between connecting and disconnecting positions in response to movement of the locking member between its locked and unlocked positions;

(g) the disconnect means being operable:

(i) when the disconnect member is in its connecting position, to drivingly connect the handle and bolt structures such that, when the handle structure is caused to move to its unlatching position; and, (ii) when the disconnect member is in its disconnecting position, to disengage the operating means at a location between the handle and body structures to thereby provide no driving connection between the handle and bolt structures, whereby the handle structure may be moved freely between its normal and operating positions without causing corresponding movement of the bolt structure; and, (h) guard means including a pair of overlying guard formations interposed between the handle structure and the body structure for preventing intruder access to said location, each of the guard formations being movable relative to the other as the handle structure moves relative to the body structure.

2. The door lock of claim 1 wherein:

(a) the handle structure is mounted on the body structure for pivotal movement about a mounting axis; and (b) the operating formation is mounted for pivotal movement about the mounting axis.

3. The door lock of claim 1 wherein the bolt structure comprises an elongate member mounted on the body structure for sliding movement relative to the body along a linear first path of travel extending longitudinally of the elongate member.

4. The door lock of claim 1 wherein the operating formation is pivotally mounted on the body structure for movement along an arcuate second path of travel.

5. The door lock of claim 1 additionally including structure defining a lost motion connection connecting the operating formation and the bolt structure for enabling the bolt structure to be moved from its latching position to its unlatching position without causing corresponding movement of the operating means.

6. The door lock of claim 5 wherein the structure defining a lost motion connection includes an elongate slot formed in the bolt structure, and the operating formation extends into the elongate slot.

7. The door lock of claim 1 wherein the connecting formation includes an abutment surface formed on the bolt structure.

8. The door lock of claim 1 wherein:

(a) the handle structure is mounted on the body structure for pivotal movement about a mounting axis; and, (b) a shaft is journaled is aligned holes formed through spaced portions of the body structure, and the axis of the aligned holes defines the mounting axis.

9. The door lock of claim 1 wherein the key-control means is directly mounted on the body structure, and the disconnect member is rotatably mounted by the key-control means.

10. The door lock of claim 1 additionally including biasing means interposed between the body and handle structures for biasing the handle structure toward its normal position relative to the body structure.

11. The door lock of claim 10 wherein the biasing means includes at least one compression coil spring interposed between selected portions of the pair of guard formations.

12. The door lock of claim 1 wherein:

(a) the handle structure and the body structure have spaced overlying portions extending on opposite sides of said location;

(b) mounting means pivotally mounts the handle structure on the body structure for movement between its normal and operating positions such that, when the handle structure moves from its normal position toward its operating position, the spaced overlying portions move relatively away from each other; and, (c) the pair of guard formations include a first structure having a first part connected to the handle structure and extending toward the body structure, and a second structure having a second part connected to the body structure and extending toward the handle structure, the first and second parts extending in overlying relationship and serving to restrict access to said location as the spaced overlying portions of the handle and body structures move relatively away from each other during pivotal movement of the handle structure relative to the body structure.

13. A door lock, comprising:

(a) a body structure;

(b) a bolt structure connected to the body structure for movement between latching and unlatching positions, the bolt structure having a connecting formation connected thereto for movement along a first path of travel relative to the body structure in response to movement of the bolt structure between its latching and unlatching positions;

(c) a handle structure connected to the body structure for movement between normal and operating positions;

(d) key control means connected to the handle structure and having a locking member which is movable relative to the handle structure between locked and unlocked positions, the key control means being operable to selectively retain the locking member in its locked and unlocked positions;

(e) operating means having an operating formation connected thereto for movement between first and second positions along a second path of travel relative to the body structure and being operable to drivingly engage the connecting formation to effect movement of the bolt structure from its latching position to its unlatching position in response to movement of the operating formation from its first position to its second position;

(f) disconnect means interposed between the operating means and the locking member for selectively drivingly connecting and disconnecting the operating means and locking member to thereby selectively drivingly connect and disconnect the handle and bolt structures, the disconnect means including a disconnect member which is movable along a third path of travel between connecting and disconnecting positions in response to movement of the locking member between its locked and unlocked positions;

(g) the disconnect means being operable:

(i) when the disconnect member is in its connecting position, to drivingly connect the handle and bolt structures such that, when the handle structure is moved to its operating position, the bolt structure is caused to move to its unlatching position;

and, (ii) when the disconnect member is in its disconnecting position, to provide disengate the operating means at a location between the handle and body structures to thereby provide no driving connection between the handle and bolt structures, whereby the handle structure may be moved freely between its normal and operating positions without causing corresponding movement of the bolt structure;

(h) the operating means being mounted on the body structure for pivotal movement about a pivot axis, and having a pair of receiving formations provided on opposite sides of the pivot axis; and, (i) the disconnect member having a pair of abutment formations, each of which is drivingly engageable with a separate one of the receiving formations when the disconnect member is in its connecting position.

14. The door lock of claim 13 wherein the operating formation is pivotally mounted on the body structure such that the second path of travel is curved along its length.

15. The door lock of claim 13 wherein at least one of the abutment formations is of curved configuration.

16. The door lock of claim 13 wherein the bolt structure comprises an elongate member mounted on the body structure for sliding movement relative to the body structure along a linear first path of travel extending longitudinally of the elongate member.

17. The door lock of claim 13 wherein:

(a) the operating formation is pivotally movable about a first axis of rotation as the handle structure moves between its normal and operating positions;

(b) the key control means mounts the disconnect member for pivotal movement about a second axis as the disconnect member moves between its connecting and disconnecting positions; and, (c) the first axis of rotation extends in a plane which is substantially perpendicular to a plane within which the second axis extends.

18. The door lock of claim 17 wherein the first and second axes intersect.

19. The door lock of claim 13 additionally including biasing means interposed between the body structure and the bolt for biasing the bolt toward its latching position.

20. The door lock of claim 13 additionally including guard means including a pair of overlying guard formations for preventing access to said location, each of said guard formations being movable relative to the other as the handle structure moves relative to the body structure.

21. The door lock of claim 20 wherein:

(a) the handle structure and the body structure have spaced overlying portions extending on opposite sides of said location;

(b) mounting means pivotally mounts the handle structure on the body structure for movement between its normal and operating positions such that, when the handle structure moves from its normal position toward its operating position, the spaced overlying portions move relatively away from each other; and, (c) the pair of guard formations include a first structure having a first part connected to the handle structure and extending toward the body structure, and a second structure having a second part connected to the body structure and extending toward the handle structure, the first and second parts extending in overlying relationship and serving to restrict access to said location as the spaced overlying portions of the handle and body structures move relatively away from each other during pivotal movement of the handle structure relative to the body structure.

22. The door lock of claim 13 additionally including structure defining a lost motion connection connecting the operating formation and the bolt structure for enabling the bolt structure to be moved from its latching position to its unlatching position without causing corresponding movement of the operating means.

23. The door lock of claim 22 wherein the structure defining a lost motion connection includes an elongate slot formed in the bolt structure, and the operating formation extends into the elongate slot.

24. The door lock of claim 13 wherein the key-control means is directly mounted on the body structure, and the disconnect member is rotatably mounted by the key-control means.

25. The door lock of claim 13 additionally including biasing means interposed between the body and handle structures for biasing the handle structure toward its normal position relative to the body structure.

26. A flush-mountable door lock, comprising:

(a) a body structure having side and back walls which cooperate to define a forwardly-facing recess, and having an opening formed through the back wall;

(b) an elongate bolt slidably supported on the body structure at a location behind a portion of the back wall, the bolt being movable between a projected position wherein the bolt is extended with respect to the body structure, and a retracted position wherein the bolt is retracted with respect to the body structure, the bolt having a receiving formation communicating with the back wall opening;

(c) a handle mounted on the body structure and being movable between a nested position wherein the handle is nested within the recess, and an operating position;

(d) disconnect linkage means including an operating member having an arm portion which extends through the back wall opening into the receiving formation for drivingly engaging the bolt, and a disconnect member having formation means thereon for movement between a connecting position wherein the disconnect member drivingly engages the operating member, and a disconnecting position wherein no driving connection is provided between the operating and disconnect member, the disconnect linkage means being operable, when the disconnect member is in its connecting position, to drivingly interconnect the handle and the bolt such that when the handle is moved out of its nested position the bolt is caused to retract, and to provide no driving connection between the handle and the bolt when the disconnect member is in its disconnecting position;

(e) key-control means carried by the handle structure for supporting the disconnect member and being operable to move the disconnect member between its connecting and disconnecting positions; and, (f) guard means for shielding the disconnect linkage means from intruder access including a pair of overlying shield formations extending across the forwardly-facing recess, each of the shield formations being movable with a separate one of the body structure and the handle structure.

27. The door lock of claim 26 wherein structure defining a lost motion connection connects the operating means and the bolt structure for enabling the bolt structure to be moved from its latching position to its unlatching position without causing corresponding movement of the operating means, whereby the bolt structure may be "slammed" into latching engagement with a suitably configured strike.

28. The door lock of claim 26 wherein:

(a) the operating member is mounted on the body structure for pivotal movement about a pivot axis, and has a pair for receiving formations provided on opposite sides of the pivot axis; and, (b) the disconnect member has a pair of abutment formations, each of which is drivingly engageable with a separate one of the receiving formations when the disconnect member is in its connecting position.

29. The door lock of claim 28 wherein the handle structure is mounted on the body structure for pivotal movement about said pivot axis.

30. The door lock of claim 26 additionally including biasing means interposed between the body and handle structures for biasing the handle structure toward its normal position relative to the body structure.

* * * * *